US010971298B2

(12) United States Patent
Lin et al.

(10) Patent No.: US 10,971,298 B2
(45) Date of Patent: Apr. 6, 2021

(54) PASSIVE COMPONENT STRUCTURE

(71) Applicant: PIN SHINE INDUSTRIAL CO., LTD., New Taipei (TW)

(72) Inventors: Chih-Hung Lin, New Taipei (TW); Kun-Chuan Chang, New Taipei (TW)

(73) Assignee: PIN SHINE INDUSTRIAL CO., LTD., New Taipei (TW)

( * ) Notice: Subject to any disclaimer, the term of this patent is extended or adjusted under 35 U.S.C. 154(b) by 320 days.

(21) Appl. No.: 16/016,841

(22) Filed: Jun. 25, 2018

(65) Prior Publication Data

US 2019/0392982 A1 Dec. 26, 2019

(51) Int. Cl.

| | |
|---|---|
| ***H01F 27/29*** | (2006.01) |
| ***H01F 27/32*** | (2006.01) |
| ***H01F 27/24*** | (2006.01) |
| *H01F 27/28* | (2006.01) |

(52) U.S. Cl.

CPC ..... *H01F 27/327* (2013.01); *H01F 27/24* (2013.01); *H01F 27/292* (2013.01); *H01F 27/323* (2013.01); *H01F 27/324* (2013.01); *H01F 27/28* (2013.01); *H01F 27/29* (2013.01)

(58) Field of Classification Search

CPC .... H01F 27/327; H01F 27/324; H01F 27/323; H01F 27/292; H01F 27/306; H01F 27/325

See application file for complete search history.

(56) References Cited

U.S. PATENT DOCUMENTS 5,684,445 A * 11/1997 Kobayashi ..... H01F 27/2866 336/206
6,522,233 B1 2/2003 Kyoso et al.
6,734,775 B2 * 5/2004 Chung ..... H01F 27/292 336/192
7,436,280 B2 * 10/2008 Jedlitschka ..... H01F 27/2876 336/200
2015/0318098 A1 11/2015 Miyamoto et al.
2015/0364245 A1 12/2015 Jang et al.

FOREIGN PATENT DOCUMENTS

| | | | |
|---|---|---|---|
| DE | 10147129 | A1 | 4/2002 |
| JP | 2010050153 | A | 3/2010 |
| KR | 20030018421 | A | 3/2003 |
| TW | 436822 | B | 5/2001 |
| TW | 201705160 | A | 2/2017 |

* cited by examiner

*Primary Examiner* — Tuyen T Nguyen

(74) *Attorney, Agent, or Firm* — Schmeiser, Olsen & Watts, LLP

(57) ABSTRACT

A passive component structure includes an insulating substrate having a centered hollow portion and provided on a surface with a coil holding zone having at least one spiral receiving recess; at least one coil held in the coil holding zone and including a winding portion received in the spiral receiving recess and connected to a first and a second terminal; an insulating encapsulation member covering at least the insulating substrate and the winding portion of the coil; and a magnetic unit engaged with the hollow portion of the insulating substrate. With these arrangements, the passive component structure can include only one coil and be configured into an inductor, or can include two coils and be configured into a transformer. Therefore, the passive component structure has the advantages of having simple structure, reduced volume and improved insulation, and can be flexibly applied to make different electronic elements at reduced cost.

2 Claims, 8 Drawing Sheets

PASSIVE COMPONENT STRUCTURE

FIELD OF THE INVENTION

The present invention relates to a passive component structure, and more particularly, to a passive component structure that can include only one coil and be configured into an inductor or include two coils and be configured into a transformer to therefore provide the advantages of having simple structure, reduced volume and improved insulation, and being flexibly applied to make different electronic elements at reduced cost.

BACKGROUND OF THE INVENTION

An inductor is a general passive component, which includes a magnetic substrate, a metal coil connected to the magnetic substrate, and a magnetic cover closed to an upper end of the magnetic substrate. The metal coil includes two legs, which are separately assembled to the magnetic substrate. The two legs of the coil are bent inward to respectively form an electrode pin. The electrode pins are connected to a bottom side of the magnetic substrate for further connecting to a circuit board. The magnetic cover is bonded to the magnetic substrate using an adhesive.

A transformer is another type of passive component, which includes a drum-shaped magnetic element having a plurality of windings wound therearound. The windings are separately electrically connected to terminal electrodes and sheet magnetic elements to form the transformer. In addition, a general transformer further includes other elements, such as bobbins, conductors, insulating members and other magnetic elements. To meet relevant safety codes, the insulation of the traditional transformer usually can be achieved in three different manners. In the first manner, isolation tapes and Teflon sleeves are used. In the second manner, the double-slot feature of the bobbin and a cover are used. In the third manner, the double-slot feature of the bobbin and the filling of epoxy resin are used. However, while all the above three manners for achieving the insulation of the conventional transformer can give the transformer an insulation satisfying the safety codes, they include relatively complicate procedures.

Further, the existing inductor and transformer have completely different manufacturing methods and could not be made using a common substrate. As a result, the existing inductor and transformer require more time to make and are relatively complicate in structure, which is of course not economical.

It therefore tried by the inventor to develop a passive component structure that can include only one coil and be configured into an inductor or include two coils and be configured into a transformer to therefore provide the advantages of having simple structure, reduced volume and improved insulation, and being flexibly applied to make different electronic elements at reduced cost.

SUMMARY OF THE INVENTION

A primary object of the present invention is to overcome the shortcomings of the prior art inductor and transformer by providing a passive component structure that can include only one coil and be configured into an inductor or include two coils and be configured into a transformer to therefore provide the advantages of having simple structure, reduced volume and improved insulation, and being flexibly applied to make different electronic elements at reduced cost.

To achieve the above and other objects, the passive component structure according to a preferred embodiment of the present invention includes an insulating substrate having a centered hollow portion and being provided on a surface with a coil holding zone; at least one coil being located in the coil holding zone of the insulating substrate and including a winding portion connected to a first and a second terminal; an insulating encapsulation member covering at least the insulating substrate and the winding portion of the coil; and a magnetic unit being engaged with the hollow portion of the insulating substrate.

In the passive component structure according to the present invention, only one coil can be included and held in the coil holding zone of the insulating substrate. In this case, the coil holding zone can be provided with a spiral receiving recess, which has an end serving as first terminal receiving recess. The winding portion of the coil is received in the spiral receiving recess and the first terminal is received in the first terminal receiving recess. Whereby the passive component structure is configured into an inductor.

In the passive component structure according to the present invention, two coils can be provided and held in the coil holding zone of the insulating substrate. In this case, the coil holding zone can be provided with two spiral receiving recesses, which respectively have an end serving as a first terminal receiving recess. The winding portions of the two coils are separately received in the two spiral receiving recesses and two first terminals are separately received in the two first terminal receiving recesses. Whereby the passive component structure is configured into a transformer.

In the passive component structure according to the present invention, in the case only one coil is included, the insulating substrate can be in the form of a round plate and further provided on another opposite surface with a second terminal receiving recess; the spiral receiving recess can be provided with a passage section communicating with the insulating substrate; and the insulating encapsulation member can be provided with a first and a second notch section located corresponding to the first and the second terminal, respectively, and includes a through hole located corresponding to the hollow portion of the insulating substrate. In this case, the winding portion of the coil includes a conducting section located in the passage section, and the second terminal is received in the second terminal receiving recess and connected to the conducting section.

In the passive component structure according to the present invention, in the case two coils are included, the insulating substrate can be in the form of a round plate and further provided on another opposite surface with two second terminal receiving recesses; the two spiral receiving recesses can be respectively provided with a passage section communicating with the insulating substrate; and the insulating encapsulation member can be provided with two first and two second notch sections located corresponding to the first and the second terminals, respectively, and includes a through hole located corresponding to the hollow portion of the insulating substrate. The winding portions of the two coils respectively include a conducting section separately located in the two passage sections, and the second terminals are separately received in the two second terminal receiving recesses and connected to the two conducting sections.

In the passive component structure according to the present invention, an insulating intermediate layer can be further included. In the case only one coil is included, the insulating substrate can be in the form of a hollow cylindrical member, and the insulating intermediate layer is located between the insulating substrate and the insulating encapsulation member to cover at least the coil holding zone and the winding portion. The insulating intermediate layer can be provided with a second terminal receiving recess having a passage section communicating with the winding portion; and the second terminal is located in the second terminal receiving recess and includes a conducting section located in the passage section and connected to the winding portion.

In the passive component structure according to the present invention, the insulating intermediate layer can be provided with a notch located corresponding to the first terminal, and the insulating encapsulation member can be provided on one side with a first notch section and a second notch section, which are arranged side by side. In this case, the first notch section is located corresponding to the notch of the insulating intermediate layer and the first terminal, and the second notch section is located corresponding to an end of the second terminal.

In the passive component structure according to the present invention, an insulating intermediate layer can be further included. In the case two coils are included, the insulating substrate can be in the form of a hollow cylindrical member, and the insulating intermediate layer is located between the insulating substrate and the insulating encapsulation member to cover at least the coil holding zone and the two winding portions. The insulating intermediate layer can be provided with two second terminal receiving recesses respectively having a passage section communicating with one of the two winding portions; and the second terminals are separately located in the second terminal receiving recesses and respectively include a conducting section. The conducting sections are separately located in the passage sections and connected to the winding portions.

In the passive component structure according to the present invention, the insulating intermediate layer can be provided with two notches located corresponding to the first terminals, and the insulating encapsulation member can be provided on two substantially diametrically opposite sides with two sets of juxtaposed first and second notch sections. The two first notch sections are located corresponding to the two notches of the insulating intermediate layer and the two first terminals, and the two second notch sections are separately located corresponding to an end of the two second terminals.

In the passive component structure according to the present invention, the magnetic unit includes a first magnetic element and a second magnetic element. The first magnetic element includes a first seat and a first magnetic body, and the first magnetic body is located on the first seat and extended through the hollow portion of the insulating substrate or the through hole of the insulating encapsulation member. The second magnetic element includes a second seat and a second magnetic body, and the second magnetic body is located on the second seat and extended through the hollow portion of the insulating substrate or the through hole of the insulating encapsulation member to contact with the first magnetic body. Whereby the first and the second seat are closed and connected to each other.

With the above arrangements, the passive component structure according to the present invention can include only one coil and be configured into an inductor, or include two coils and be configured into a transformer to thereby provide the advantages of having simple structure, reduced volume and improved insulation, and being flexibly applied to make different electronic elements at reduced cost.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with some preferred embodiments thereof and by referring to the accompanying drawings.

Figure 1:
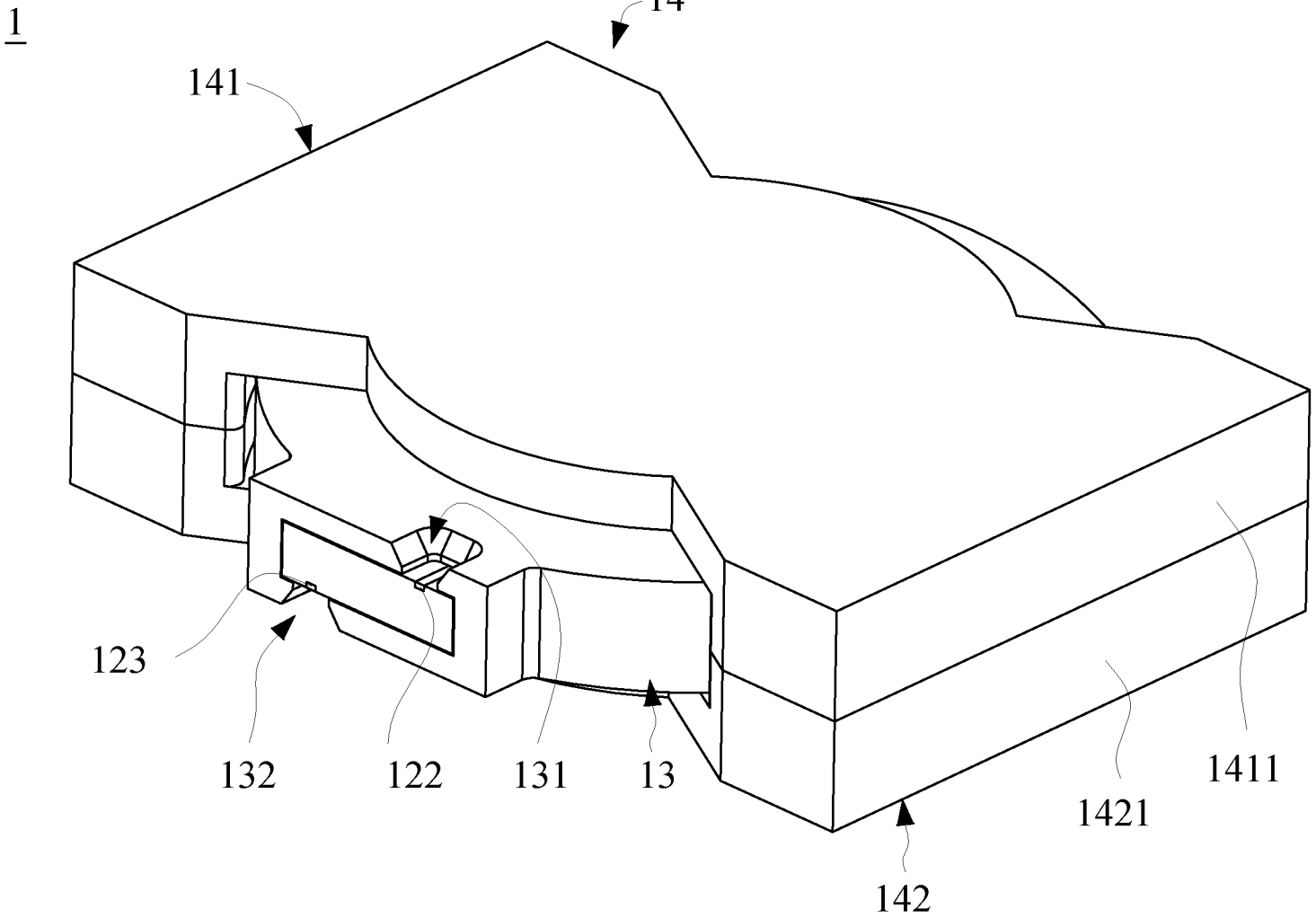
FIG. 1 is an assembled perspective view of a passive component structure according to a first preferred embodiment of the present invention.
Figure 2:
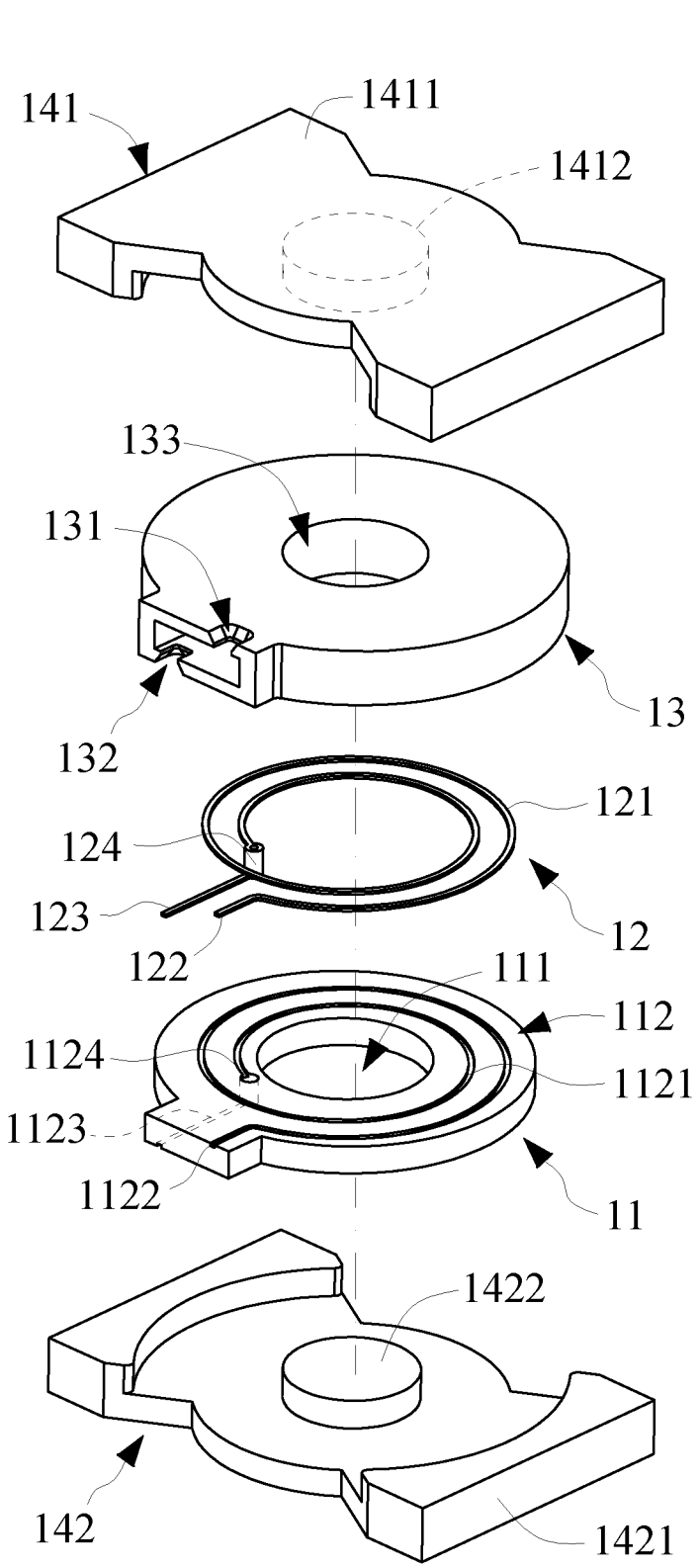
FIG. 2 is an exploded view of FIG. 1.

Please refer to FIGS. 1 and 2, which are assembled and exploded perspective views, respectively, of a passive component structure 1 according to a first preferred embodiment of the present invention. As shown, in the first preferred embodiment, the passive component structure 1 includes an insulating substrate 11, a coil 12, an insulating encapsulation member 13, and a magnetic unit 14.

The insulating substrate 11 has a centered hollow portion 111, and is provided on a surface with a coil holding zone 112. The three-dimensional insulating substrate 11 can be made of an epoxy resin material.

The coil 12 is located in the coil holding zone 112 of the insulating substrate 11, and includes a winding portion 121 connected to a first terminal 122 and a second terminal 123.

The insulating encapsulation member 13 covers at least the insulating substrate 11 and the winding portion 121; and can be made of a plastic material, a rubber material, a thermoplastic plastic material, or an epoxy resin material.

The magnetic unit 14 is engaged with the hollow portion 111 of the insulating substrate 11.

The passive component structure 1 according to the first preferred embodiment of the present invention can be used to make an inductor. In this case, the insulating substrate 11 is in the form of a round plate, and only one coil 12 is held in the coil holding zone 112 of the insulating substrate 11. In the coil holding zone 112, there is formed a spiral receiving recess 1121, in which the winding portion 121 of the coil 12 is received. Alternatively, the coil holding zone 112 is located on the surface of the insulating substrate 11 and the coil 12 is directly located in the coil holding zone 112 on the same surface of the insulating substrate 11. An end of the spiral receiving recess 1121 provides a first terminal receiving recess 1122, in which the first terminal 122 is received. The insulating substrate 11 is provided on another opposite surface with a second terminal receiving recess 1123, in which the second terminal 123 is received. The spiral receiving recess 1121 is provided with a passage section 1124, which communicates with the insulating substrate 11. The winding portion 121 of the coil 12 includes a conducting section 124, which is located in the passage section 1124 and connected to the second terminal 123. The insulating encapsulation member 13 is provided with a first notch section 131 and a second notch section 132, which are located corresponding to the first terminal 122 and the second terminal 123, respectively. The insulating encapsulation member 13 also includes a through hole 133, which is located corresponding to the hollow portion 111 of the insulating substrate 11 and has the magnetic unit 14 connected thereto. With the above arrangements, an inductor is formed using the passive component structure 1, and the inductor so formed can be electrically connected to a related apparatus or other electronic elements (not shown) via the first and the second terminal 122, 123.

In the passive component structure 1 according to the first preferred embodiment, the magnetic unit 14 includes a first magnetic element 141 and a second magnetic element 142. The first magnetic element 141 includes a first seat 1411 and a first magnetic body 1412 located on the first seat 1411. The first magnetic body 1412 is extended through the through hole 133 of the insulating encapsulation member 13. The second magnetic element 142 includes a second seat 1421 and a second magnetic body 1422 located on the second seat 1421. The second magnetic body 1422 is also extended through the through hole 133 of the insulating encapsulation member 13 to contact with the first magnetic body 1412, so that the first and the second seat 1411, 1421 are closed and connected to each other.

Figure 3:
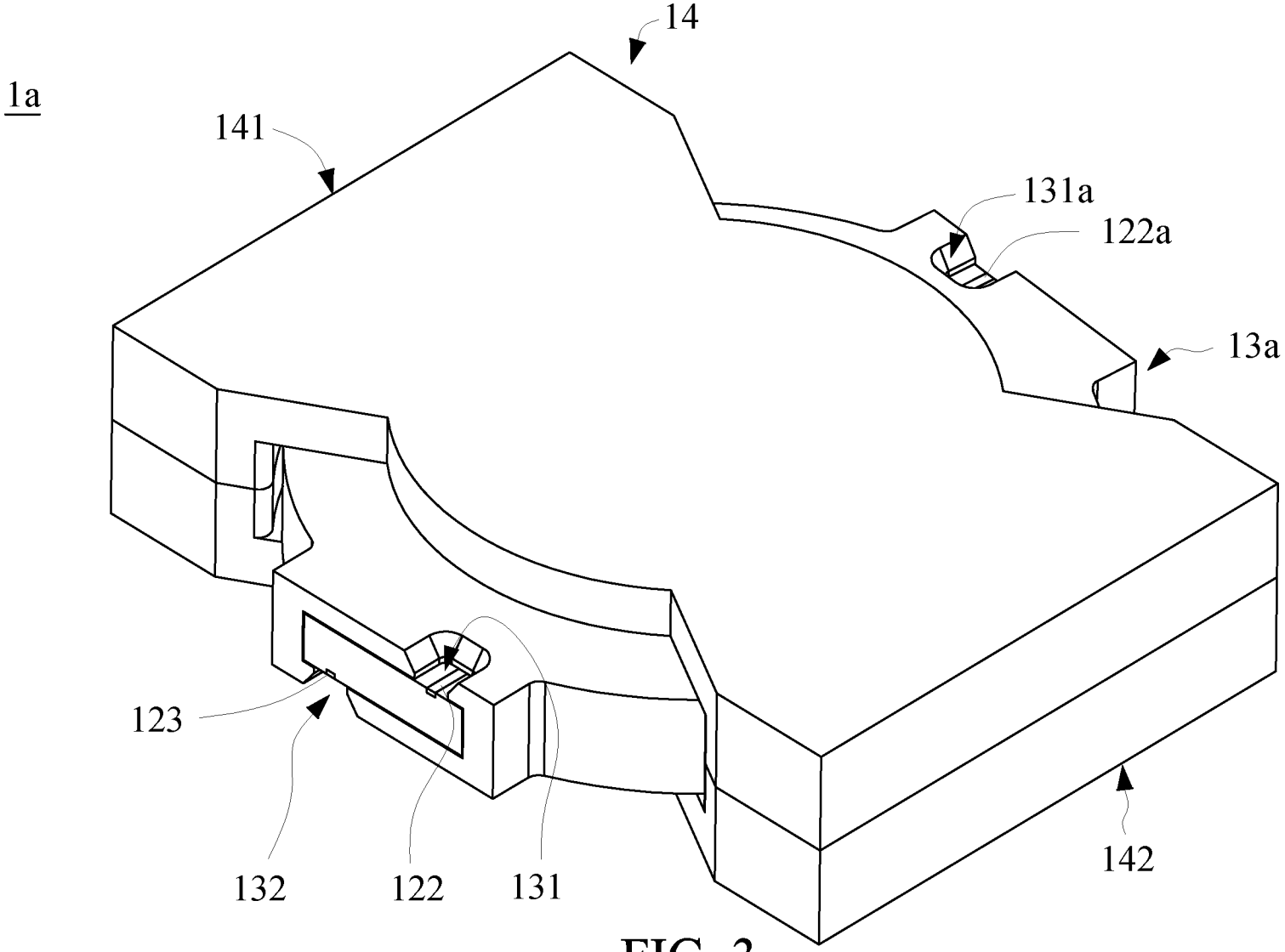
FIG. 3 is an assembled perspective view of a passive component structure according to a second preferred embodiment of the present invention.
Figure 4:
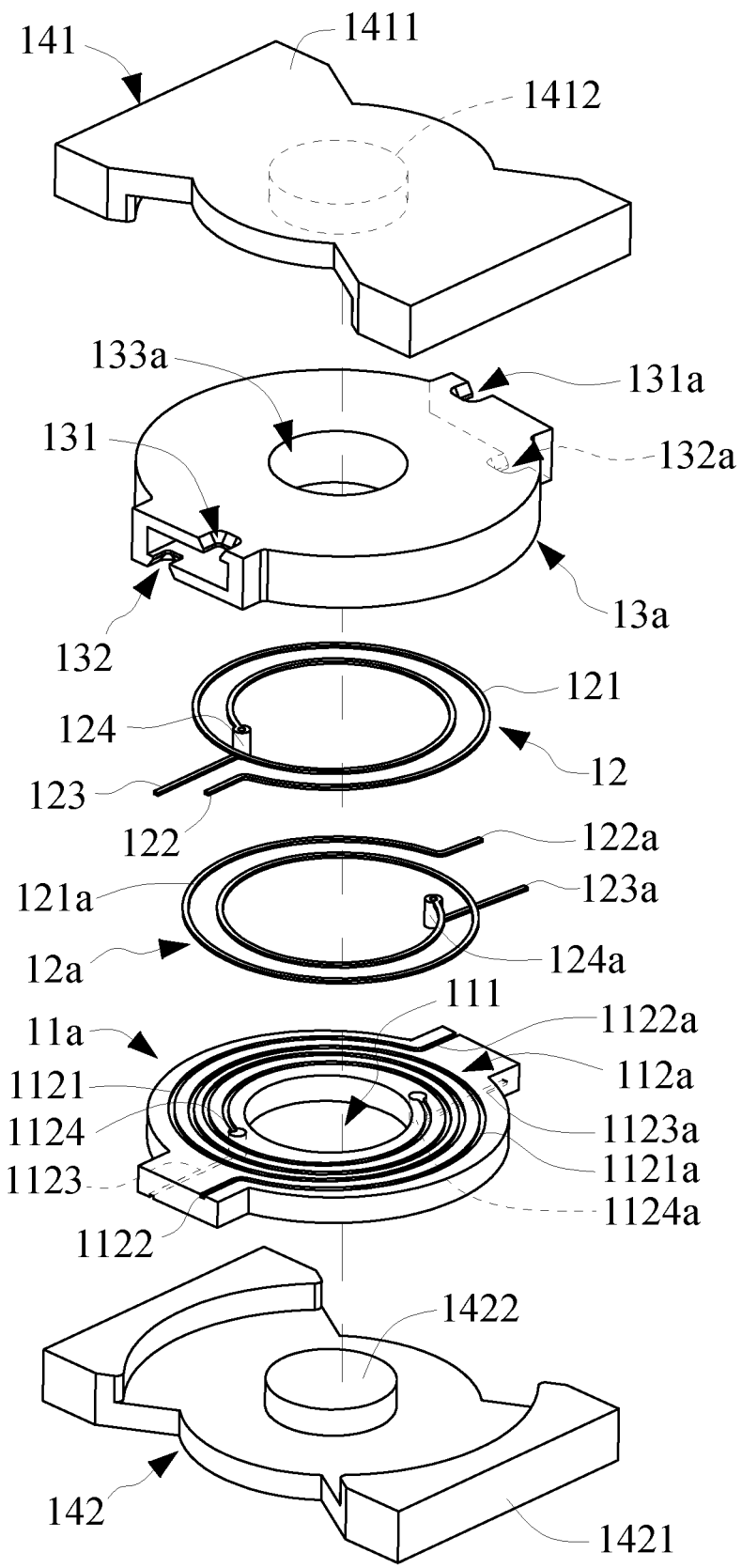
FIG. 4 is an exploded view of FIG. 3.

Please refer to FIGS. 3 and 4, which are assembled and exploded perspective views, respectively, of a passive component structure 1*a* according to a second preferred embodiment of the present invention. As shown, in the second preferred embodiment, the passive component structure 1*a* includes an insulating substrate 11*a* in the form of a round plate having a centered hollow portion 111, two coils 12, 12*a*, an insulating encapsulation member 13*a*, and a magnetic unit 14. The passive component structure 1*a* can be used to make a transformer. The insulating substrate 11*a* is provided on a surface with a coil holding zone 112*a*, in which the two coils 12, 12*a* are held. More specifically, in the coil holding zone 112*a*, there are two spiral receiving recesses 1121, 1121*a*, in which winding portions 121, 121*a* of the two coils 12, 12*a*, respectively, are received. Alternatively, the coil holding zone 112*a* is located on the surface of the insulating substrate 11*a* and the coils 12, 12*a* are directly located in the coil holding zone 112*a* on the same surface of the insulating substrate 11*a*. The spiral receiving recesses 1121, 1121*a* respectively have an end forming a first terminal receiving recess 1122, 1122*a*, in which two first terminals 122, 122*a* are received. The insulating substrate 11*a* is provided on another opposite surface with two second terminal receiving recesses 1123, 1123*a*, in which two second terminals 123, 123*a* are received. The spiral receiving recesses 1121, 1121*a* are provided with a passage section 1124, 1124*a*, respectively, which communicate with the insulating substrate 11*a*. The winding portions 121, 121*a* of the coils 12, 12*a* respectively include a conducting section 124, 124*a*, which are located in the passage sections 1124, 1124*a* and connected to the second terminals 123, 123*a*. The insulating encapsulation member 13*a* is provided with two first notch sections 131, 131*a*, which are located corresponding to the first terminals 122, 122*a*, respectively, and two second notch sections 132, 132*a*, which are located corresponding to the second terminals 123, 123*a*, respectively. The insulating encapsulation member 13*a* also includes a through hole 133*a*, which is located corresponding to the hollow portion 111 of the insulating substrate 11*a*. The magnetic unit 14 in the second preferred embodiment is the same as that in the first preferred embodiment. The first magnetic body 1412 of the first magnetic element 141 and the second magnetic body 1422 of the second magnetic element 142 are extended through the through hole 133*a* of the insulating encapsulation member 13*a* to thereby connect the first seat 1411 to the second seat 1421. With the above arrangements, a transformer is formed using the passive component structure 1*a*, and the transformer so formed can be electrically connected to a related apparatus or other electronic elements (not shown) via the first terminals 122, 122*a* and the second terminals 123, 123*a*.

Figure 5:
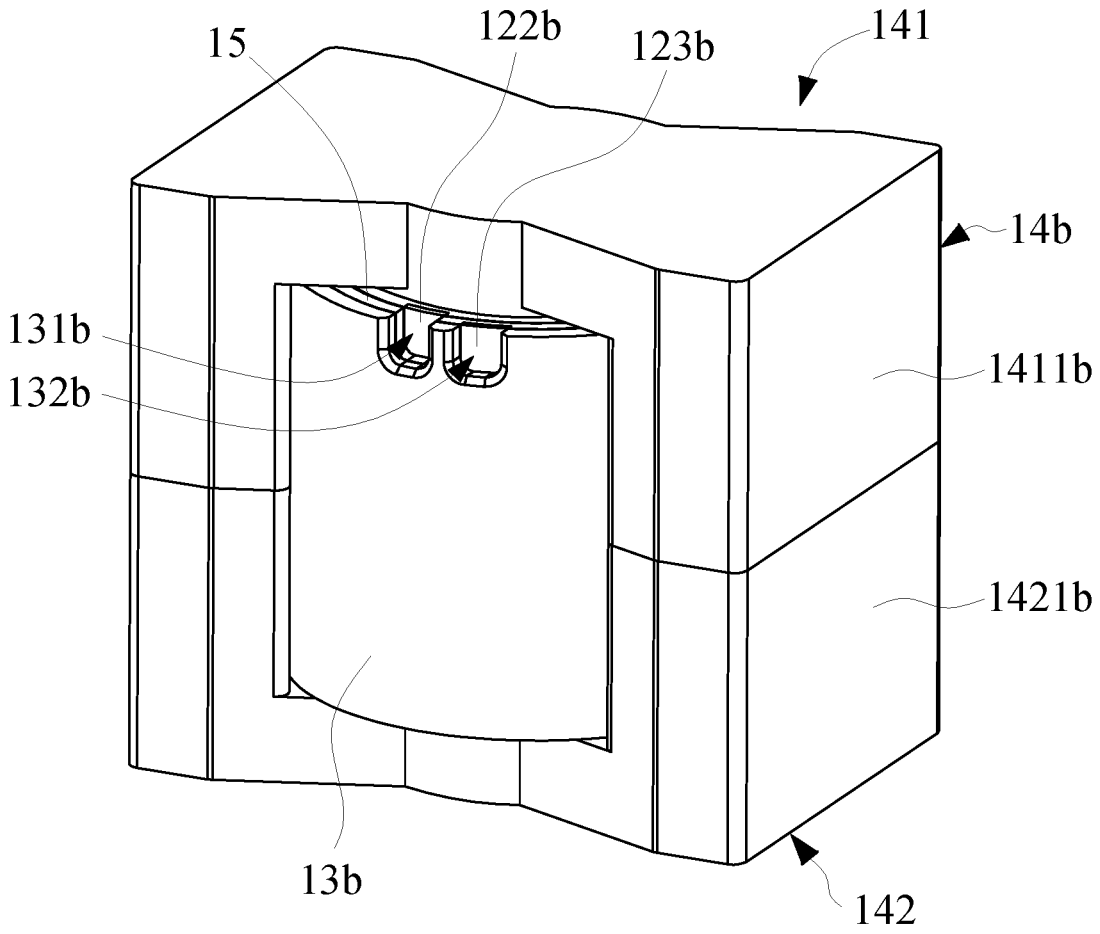
FIG. 5 is an assembled perspective view of a passive component structure according to a third preferred embodiment of the present invention.
Figure 6:
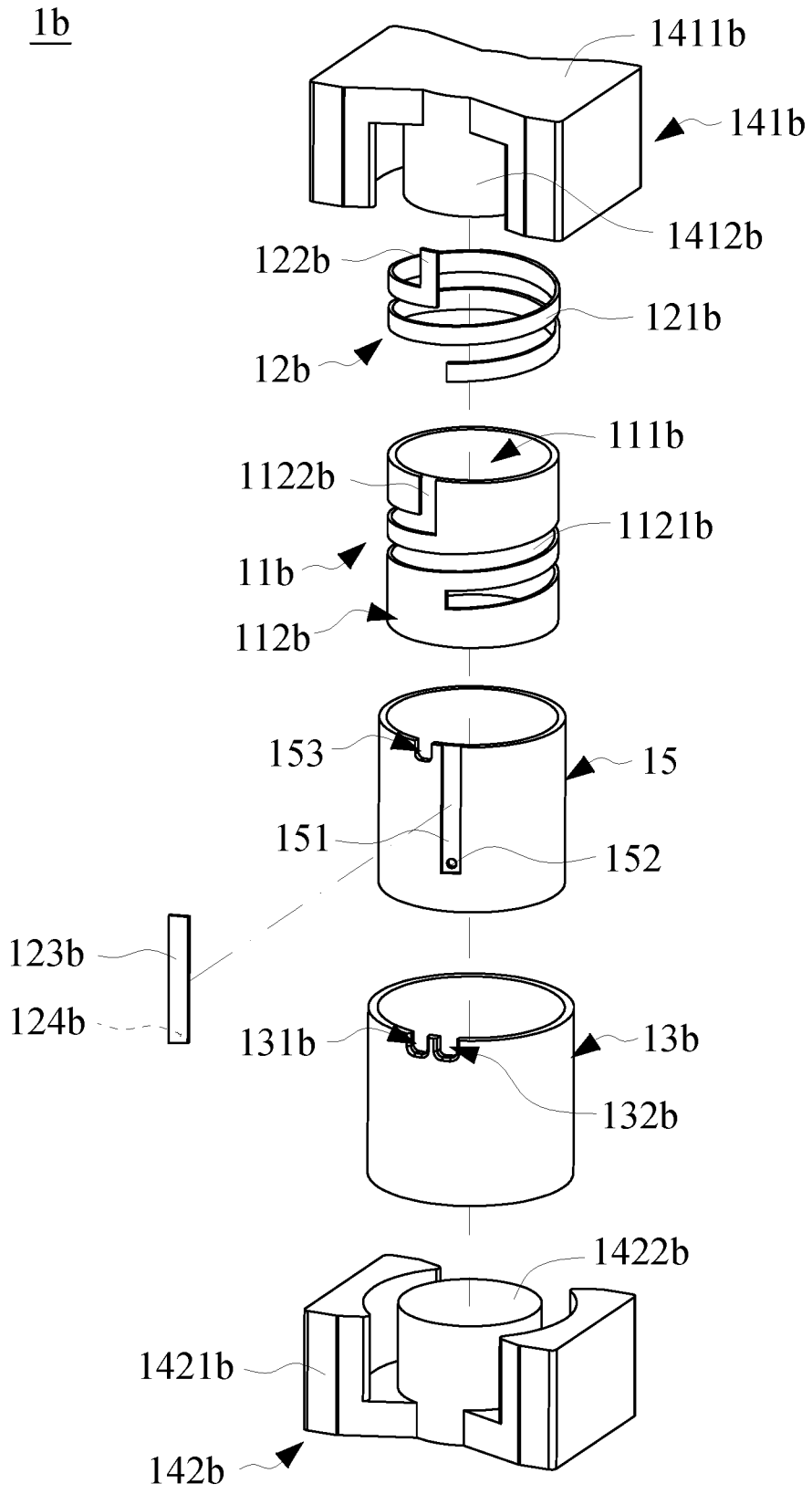
FIG. 6 is an exploded view of FIG. 5.

Please refer to FIGS. 5 and 6, which are assembled and exploded perspective views, respectively, of a passive component structure 1*b* according to a third preferred embodiment of the present invention. As shown, in the third preferred embodiment, the passive component structure 1*b* includes an insulating substrate 11*b* in the form of a cylindrical member having a hollow portion 111*b*; a coil 12*b*; an insulating encapsulation member 13*b*; a magnetic unit 14*b*; and an insulating intermediate layer 15 located between the insulating substrate 11*b* and the insulating encapsulation member 13*b*. The passive component structure 1*b* can be used to make another type of inductor. The insulating substrate 11*b* is provided on a surface with a coil holding zone 112*b*, in which the coil 12*b* is held. In the coil holding zone 112*b*, there is formed a spiral receiving recess 1121*b*, in which a winding portion 121*b* of the coil 12*b* is received. Alternatively, the coil holding zone 112*b* is located on the surface of the insulating substrate 11*b* and the coil 12*b* is directly located in the coil holding zone 112*b* on the same surface of the insulating substrate 11*b*. An end of the spiral receiving recess 1121*b* provides a first terminal receiving recess 1122*b*, in which a first terminal 122*b* is received. The insulating intermediate layer 15 is cylindrical in shape for covering at least the coil holding zone 112*b* and the winding portion 121*b*, and is provided with a second terminal receiving recess 151 having a passage section 152 communicating with the winding portion 121*b*. A second terminal 123*b* is located in the second terminal receiving recess 151, and includes a conducting section 124*b* located in the passage section 152 and connected to the winding portion 121*b*. Further, the insulating intermediate layer 15 is provided with a notch 153, which is located corresponding to the first terminal 122*b*. The insulating encapsulation member 13*b* is cylindrical in shaped and provided at an end of a circumferential wall thereof with a first notch section 131*b* and a second notch section 132*b*, which are arranged side by side. The first notch section 131*b* is located corresponding to the notch 153 and the first terminal 122*b*; and the second notch section 132*b* is located corresponding to an end of the second terminal 123*b*. The magnetic unit 14*b* includes a first magnetic element 141*b* having a first seat 1411*b* and a first magnetic body 1412*b*, and a second magnetic element 142*b* having a second seat 1421*b* and a second magnetic body 1422*b*. The first magnetic body 1412*b* and the second magnetic body 1422*b* are extended through the hollow portion 111*b* of the insulating substrate 11*b* to connect the first seat 1411*b* to the second seat 1421*b*. With the above arrangements, a different type of inductor is formed using the passive component structure 1*b*, and the inductor so formed can be electrically connected to a related apparatus or other electronic elements (not shown) via the first and the second terminal 122*b*, 123*b*.

Figure 7:
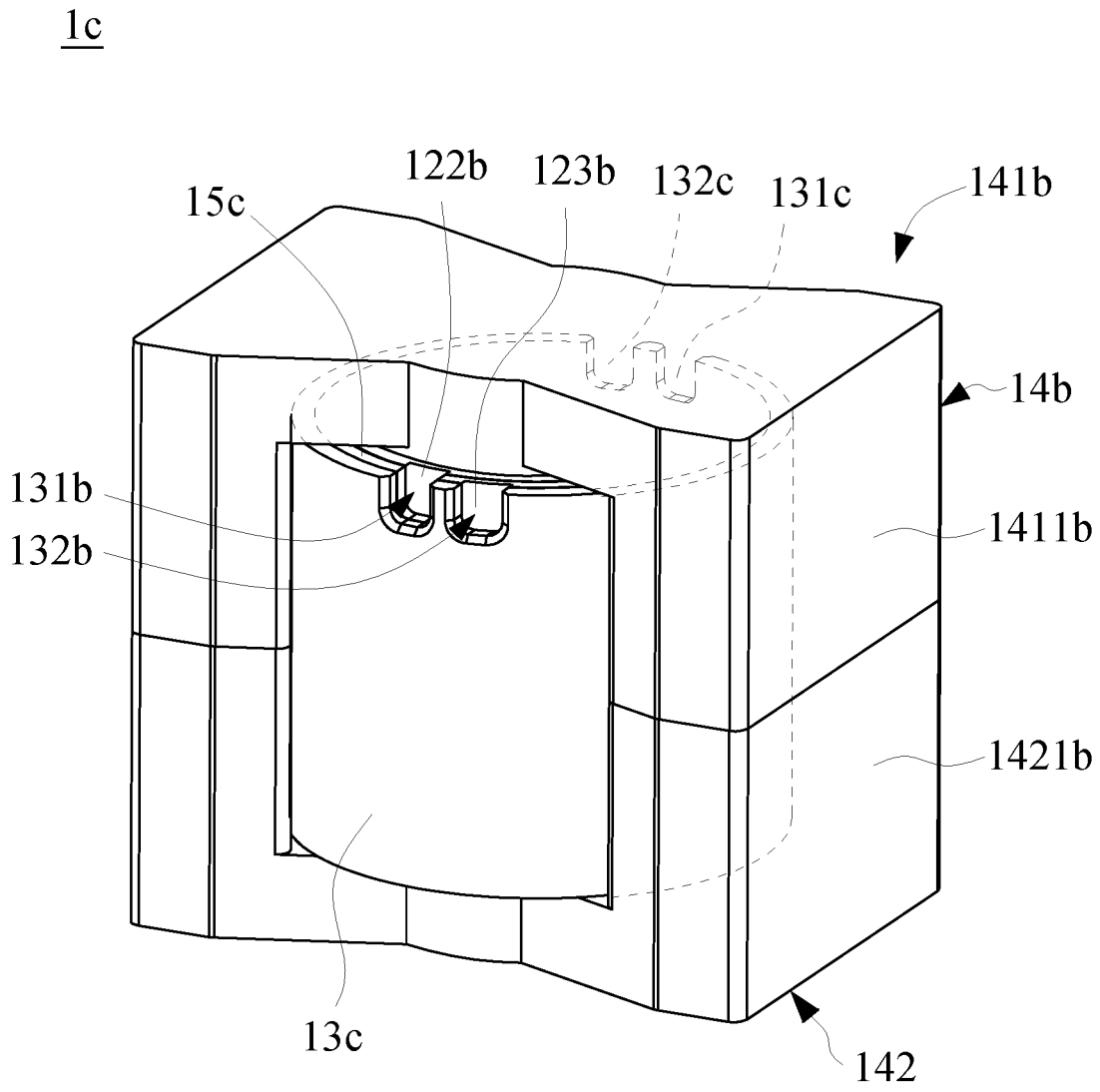
FIG. 7 is an assembled perspective view of a passive component structure according to a fourth preferred embodiment of the present invention.
Figure 8:
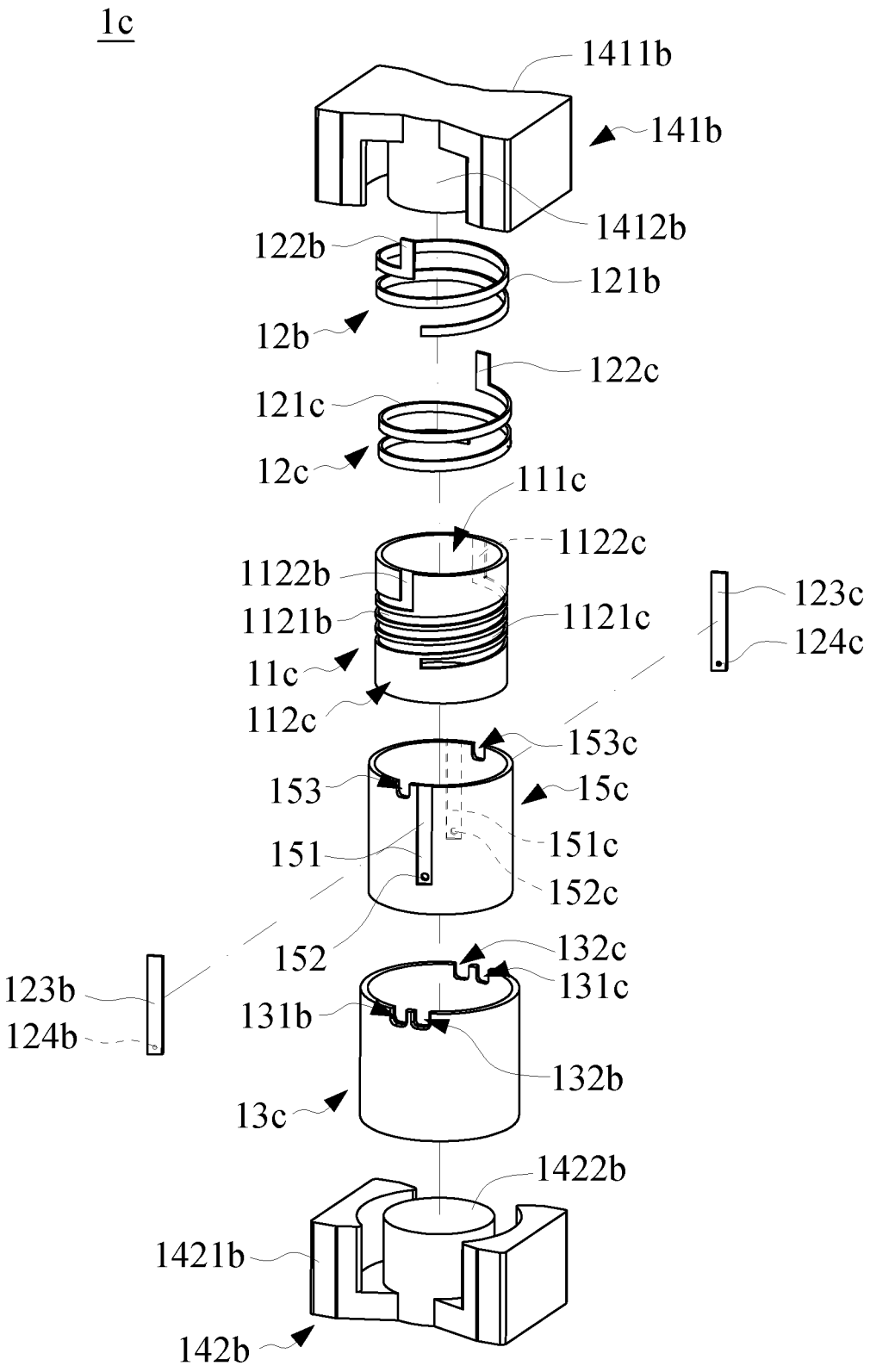
FIG. 8 is an exploded view of FIG. 7.

Please refer to FIGS. 7 and 8, which are assembled and exploded perspective views, respectively, of a passive component structure 1*c* according to a fourth preferred embodiment of the present invention. As shown, in the fourth preferred embodiment, the passive component structure 1*c* includes an insulating substrate 11*c* in the form of a cylindrical member having a centered hollow portion 111*c*; two coils 12*b*, 12*c*; an insulating encapsulation member 13*c*; a magnetic unit 14*b*; and an insulating intermediate layer 15*c* located between the insulating substrate 11*c* and the insulating encapsulation member 13*c*. The passive component structure 1*c* can be used to make another type of transformer. The insulating substrate 11*c* is provided on a surface with a coil holding zone 112*c*, in which the two coils 12*b*, 12*c* are held. More specifically, in the coil holding zone 112*c*, there are two spiral receiving recesses 1121*b*, 1121*c*, in which winding portions 121*b*, 121*c* of the two coils 12*b*, 12*c*, respectively, are received. Alternatively, the coil holding zone 112*c* is located on the surface of the insulating substrate 11*c* and the coils 12*b*, 12*c* are directly located in the coil holding zone 112*c* on the same surface of the insulating substrate 11*c*. The spiral receiving recesses 1121*b*, 1121*c* respectively have an end forming a first terminal receiving recess 1122*b*, 1122*c*, in which two first terminals 122*b*, 122*c* are received. The insulating intermediate layer 15*c* is cylindrical in shape for covering at least the coil holding zone 112*c* and the winding portions 121*b*, 121*c*, and is provided with two second terminal receiving recesses 151, 151*c*, which respectively have a passage section 152, 152*c* communicating with one of the two winding portions 121*b*, 121*c*. Two second terminals 123*b*, 123*c* are located in the second terminal receiving recesses 151, 151*c*, respectively, and respectively include a conducting section 124*b*, 124*c* located in the passage sections 152, 152*c* and connected to the winding portions 121*b*, 121*c*. Further, the insulating intermediate layer 15*c* is provided with two notches 153, 153*c*, which are located corresponding to the first terminals 122*b*, 122*c*, respectively. The insulating encapsulation member 13*c* is cylindrical in shaped and provided at two substantially diametrically opposite ends of a circumferential wall thereof with two sets of juxtaposed first and second notch sections 131*b*/132*b* and 131*c*/132*c*. The first notch sections 131*b*, 131*c* are located corresponding to the notches 153, 153*c* and the first terminals 122*b*, 122*c*; and the second notch sections 132*b*, 132*c* are located corresponding to an end of the second terminals 123*b*, 123*c*, respectively. The magnetic unit 14*b* in the fourth preferred embodiment is the same as that in the third preferred embodiment. The first magnetic body 1412*b* of the first magnetic element 141*b* and the second magnetic body 1422*b* of the second magnetic element 142*b* are extended through the hollow portion 111*c* of the insulating substrate 11*c* to thereby connect the first seat 1411*b* to the second seat 1421*b*. With the above arrangements, a different type of transformer is formed using the passive component structure 1*c*, and the transformer so formed can be electrically connected to a related apparatus or other electronic elements (not shown) via the first terminals 122*b*, 122*c* and the second terminals 123*b*, 123*c*.

The present invention has been described with some preferred embodiments thereof and it is understood that the preferred embodiments are only illustrative and not intended to limit the present invention in any way and many changes and modifications in the described embodiments can be carried out without departing from the scope and the spirit of the invention that is intended to be limited only by the appended claims.

What is claimed is:

1. A passive component structure, comprising:

an insulating substrate having a centered hollow portion and being provided on a surface with a coil holding zone;

at least one coil being located in the coil holding zone of the insulating substrate and including a winding portion connected to a first terminal and a second terminal;

an insulating encapsulation member covering at least the insulating substrate and the winding portion of the coil; and a magnetic unit being engaged with the hollow portion of the insulating substrate;

wherein two coils are held in the coil holding zone of the insulating substrate, and the coil holding zone is provided with two spiral receiving recesses, which respectively have an end serving as a first terminal receiving recess; and the winding portions of the two coils being separately received in the two spiral receiving recesses and the first terminals being separately received in the two first terminal receiving recesses; whereby the passive component structure is configured into a transformer;

wherein the insulating substrate is in the form of a round plate and further provided on another opposite surface with two second terminal receiving recesses, the two spiral receiving recesses are respectively provided with a passage section communicating with the insulating substrate, and the insulating encapsulation member is provided with two first and two second notch sections located corresponding to the first and the second terminals, respectively, and includes a through hole located corresponding to the hollow portion of the insulating substrate; and the winding portions of the two coils respectively including a conducting section separately located in the two passage sections, and the second terminals being separately received in the two second terminal receiving recesses and connected to the two conducting sections.

2. The passive component structure as claimed in claim 1, wherein the magnetic unit includes a first magnetic element and a second magnetic element; the first magnetic element including a first seat and a first magnetic body, and the first magnetic body being located on the first seat and extended through the hollow portion of the insulating substrate or the through hole of the insulating encapsulation member; the second magnetic element including a second seat and a second magnetic body, and the second magnetic body being located on the second seat and extended through the hollow portion of the insulating substrate or the through hole of the insulating encapsulation member to contact with the first magnetic body, whereby the first and the second seat are closed and connected to each other.

* * * * *